US005988788A

United States Patent [19]

Suzuki et al.

[11] Patent Number: 5,988,788

[45] Date of Patent: Nov. 23, 1999

[54] INK JET RECORDER INCLUDING AN INK RECOVERY UNIT FOR PREVENTING AIR BUBBLES BY INDIVIDUALLY CONTROLLING MOVEMENT OF CAP MEMBERS AND CLOSING MEMBERS AND METHOD OF USE

[75] Inventors: Takashi Suzuki; Tatsuhiro Ishize; Takaaki Sekiyama, all of Ebina, Japan

[73] Assignee: Fuji Xerox Co., Ltd., Tokyo, Japan

[21] Appl. No.: 08/746,484

[22] Filed: Nov. 12, 1996

[30] Foreign Application Priority Data

Nov. 16, 1995 [JP] Japan ..... 7-298324

[51] Int. Cl.[6] ..... B41J 2/165

[52] U.S. Cl. ..... 347/30

[58] Field of Search ..... 347/29, 30, 32, 347/24, 22

[56] References Cited

U.S. PATENT DOCUMENTS 5,086,305 2/1992 Terasawa ..... 347/30
5,138,343 8/1992 Aichi et al. ..... 347/30
5,625,385 4/1997 Suzuki ..... 347/30

FOREIGN PATENT DOCUMENTS 2-1325 1/1990 Japan .
5-270006 10/1993 Japan .
6-143593 5/1994 Japan ..... 347/29

*Primary Examiner*—N. Le
*Assistant Examiner*—Thien Tran
*Attorney, Agent, or Firm*—Oliff & Berridge, PLC

[57] ABSTRACT

In the ink jet holder, a plurality of cap members are disposed in such a manner that they can be contacted with a plurality of record heads, respectively. Each of the cap members includes an air-communication passage which allows the interior of the cap member to communicate with the air, while the air-communication passage can be closed or opened by the corresponding closing member for each of the record heads. With the cap members respectively contacted with the record heads, and also with the air-communication passages respectively closed by the closing members, if suction pumps are operated, then the ink jet holder executes a first suction step of sucking ink from the record heads. On the other hand, with the cap members respectively contacted with the record heads, and also with the closing members separated from the air-communication passages, if the suction pumps are operated, then the ink jet holder executes a second suction step of sucking ink from the cap members. For each of the record heads, by carrying out the same suction steps or different suction steps at the same time, a necessary suction step is executed for the necessary record head, thereby being able to recover the ink jet port of the record head.

17 Claims, 8 Drawing Sheets

INK JET RECORDER INCLUDING AN INK RECOVERY UNIT FOR PREVENTING AIR BUBBLES BY INDIVIDUALLY CONTROLLING MOVEMENT OF CAP MEMBERS AND CLOSING MEMBERS AND METHOD OF USE

BACKGROUND OF THE INVENTION

The present invention relates to an ink jet recorder which jets out ink from an ink jet port for recording and, in more particular, to recovery means and method for recovering ink in the ink jet port of the record head in a non-printing area.

The prior art of this type is disclosed in the Unexamined Japanese Patent Application Publication No. Hei. 2-1325.

In an ink jet recorder, when a record head is out of operation and waits at the home position (in a non-printing area), the ink jet nozzle (exactly, an ink jet port thereof) of the record head is covered with a cap to keep the ink from drying, thereby not only preventing the ink jet nozzle from being clogged with the dry ink but also protecting it against dust. Further, when undesirable phenomena such as the clogged ink jet nozzle due to the dry ink, dust adhesion or the like occur, in order to recover the condition of the record head to the normal condition as the need arises, there is provided a recovery device in which a suction pump is connected to the cap, the suction pump is operated to generate a negative pressure on the cap side to thereby discharge the dry ink and adhered dust, which are the causes of the clogged nozzle, into the cap, a flexible tube is connected to the cap, and then the thus discharged ink and dust are collected by the tube.

In a ink jet recorder for color recording, normally, record is carried out in yellow, magenta (red), cyan (blue), and black inks, exclusive record heads are provided for the respective color inks, and caps are provided respectively for the record heads. However, in the ink jet recorder of this type, due to the fact that, when executing a recovery operation, the inks are sucked from all record heads, even the ink requiring no recovery is sucked, which results in the unnecessary or wasteful consumption of the ink.

In order to make up for this drawback, in the above-mentioned publication, there is disclosed means which is disposed on the suction pump side and can be used to select one of two ink communication systems, one of them provided between the black ink head and the capping means and the other between the color ink heads and their respective capping means.

However, in the disclosed ink jet recorder, since all inks are sucked from the color record heads when carrying out the recovery operation, the inks are still consumed wastefully. Also, the mechanisms of the disclosed ink jet recorder are complicated, which makes it difficult to secure the airtight condition of the ink suction passage thereof.

Further, in a process on the way to the capping condition, because the volume of the cap is decreased only slightly, a very small positive pressure is generated within the cap to thereby cause the ink filled up in the jet port of the record head to move back to the ink tank side, which raises a possibility that a print failure can occur when starting a recording operation.

In addition, when the ink flowed from the record head is still retained within the cap, unless it is collected completely, then there arises another possibility. That is, when the flexible or elastic cap is contacted with the record head, the volume of the cap is decreased to thereby generate a positive pressure, while this positive pressure pushes out the ink retained within the cap from an air-communication passage. As a result, not only the neighboring portions of the ink jet recorder can be contaminated but also the air can be pushed in from the ink jet nozzle due to the positive pressure to thereby impair the quality of an image printed on a recording sheet.

The present invention aims at solving the above-mentioned problems found in the conventional ink jet recorder.

SUMMARY OF THE INVENTION

Accordingly, it is an object of the invention to provide an ink jet recorder which not only can suck ink accurately to thereby prevent air bubbles from mixing into an ink supply passage without consuming ink wastefully but also can keep cap means in a stable condition and obtain a good image quality in a recording medium. Also, it is another object of the invention to provide a recovery method for recovering the function of an ink jet port of a record head in a non-printing area.

In attaining the above object, according to the invention, there is provided an ink jet recorder which comprises a plurality of record heads each including an ink jet port and capable of jetting out ink from the ink jet port for printing on a recording sheet; a head carriage carrying the above-mentioned record heads thereon and movable reciprocatingly in a main scan direction between a printing area and a non-printing area; and, a recovery device, when the head carriage is situated in the non-printing area, for recovering the record heads, wherein the recovery device comprising: a plurality of cap members respectively so disposed in the non-printing area as to correspond to the plurality of record heads and each movable between a position for covering the ink jet port of the corresponding record head and a position separated from the record head; ink suction means communicating with the cap members and capable of sucking ink in the ink jet port through the cap member; a plurality of air-communication passages respectively so disposed as to correspond to the cap members for allowing the interiors of the cap members to communicate with the air; a plurality of closing members respectively so disposed as to correspond to the plurality of air-communication passages and each movable between a position for closing the corresponding communication passage and a position separated from the communication passage; and, control means for controlling the movements of the cap members individually and for controlling the movements of the closing members individually.

Also, the above-mentioned recovery device further has functions as follows:

That is, when the cap member is moved to the position for covering the ink jet port of the record head and the closing member is moved to the position separated from the air-communication passage by the control means, the ink suction means carries out a first suction step of sucking ink from the ink jet port through the cap member.

Also, when the cap member is moved to the position separated from the record head and the closing member is moved to the position separated from the air-communication passage by the control means, the ink suction means carries out a second suction step of sucking ink retained in the cap member.

Further, the control means controls the plurality of cap members in such a manner that they carry out the same suction step, or, in such a manner that one cap member executes the first suction step and the other cap member executes the second suction step.

In attaining another object, according to the invention, there is provided a method for recovering ink in a record head in an ink jet recorder which comprises a plurality of record heads each movable reciprocatingly in a main scan direction and capable of jetting out from an ink jet port thereof for printing on a recording sheet, and a recovery device capable of carrying out an ink recovery operation for the respective record heads, the method comprising: a capping step of, when the record head is situated at a recovery position thereof, covering the record head with a cap member so disposed as to correspond to the record head; a suction step of, after execution of the capping step, sucking ink from the record head through the cap member; and, an air-communication step of opening an air-communication passage provided in the cap member, the method further being capable of deciding whether the above-mentioned capping step, suction step, and air-communication step are respectively to be executed or not for each of the record heads.

DETAILED DESCRIPTION OF THE PREFERRED EMBODIMENTS

Now, description will be given below of embodiments of an ink jet recorder and an ink recovery method according to the invention with reference to the accompanying drawings.

Figure 11:
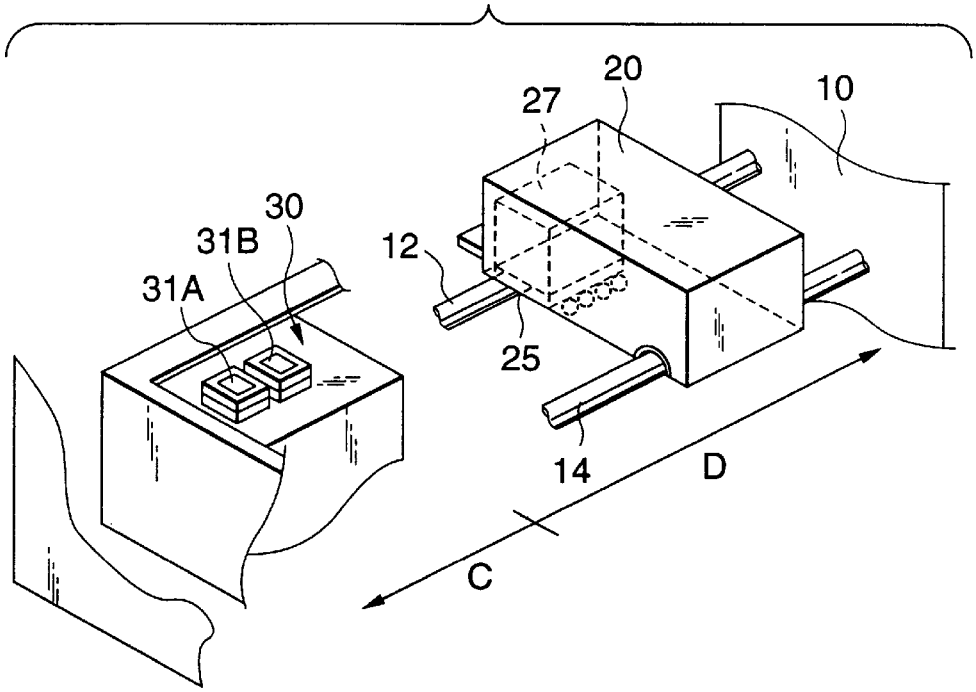
FIG. 11 is a partially perspective view of the present ink jet recorder.
Figure 12:
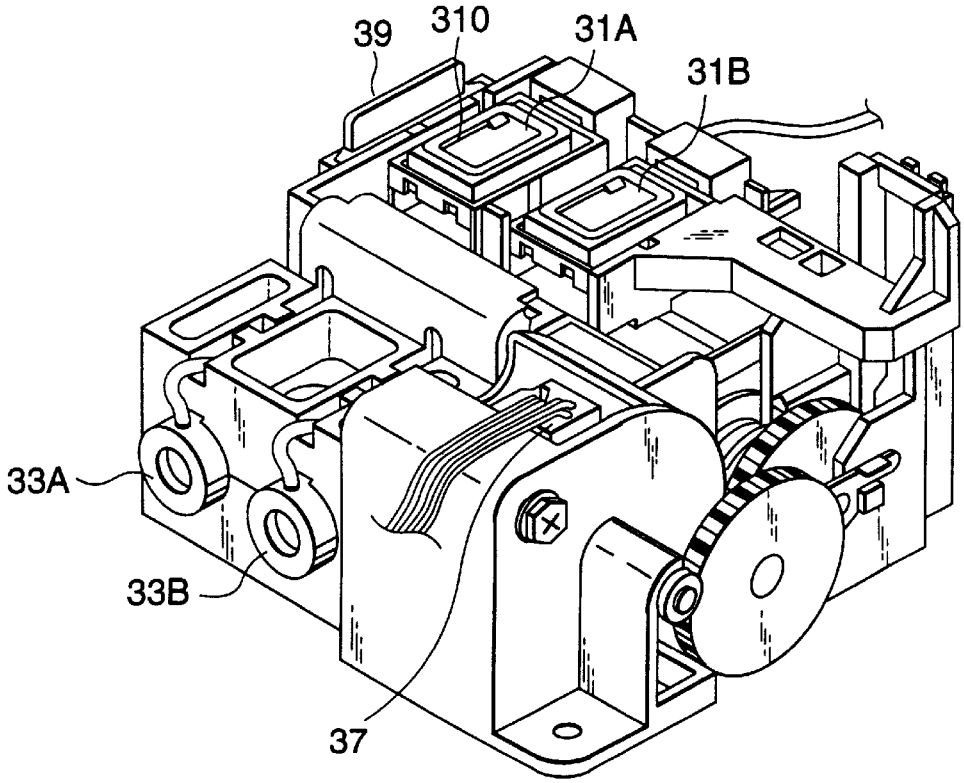
FIG. 12 is a perspective view of the recovery device.

FIG. 11 is a partially perspective view of an ink jet recorder according to the invention, while FIG. 12 is a perspective view of the whole of a recovery device employed in the ink jet recorder according to the invention.

The present ink jet recorder includes a box body 10, a drive shaft 12 and a guide shaft 14 respectively provided across the box body 10, and a carriage 20 mounted on the drive shaft 12 and guide shaft 14. The carriage 20 includes therein a record head 25 capable of jetting out different colors of ink, and an ink tank for supplying ink to the record head 25. Also, the carriage 20 can be guided by the drive shaft 12 and guide shaft 14 in such a manner that it is free to move in a direction of an arrow shown in FIG. 11, that is, while the carriage 20 is moving in a printing area D, the record head 25 jets out ink to thereby execute printing and recording on a recording sheet (not shown).

When the carriage 20 moves to a non-printing area C and stops at a home position or a recovery position, a recovery device 30 is situated at a position corresponding to the record head.

The recovery device 30 includes caps 31 (A, B) respectively for covering the record heads 25 to thereby prevent the record head 25 from drying or protect the same against dust adhesion, suction pumps 33 (A, B) respectively connected to the caps 31 for sucking ink from the record heads 25 through the caps, a drive motor 37 for driving the suction pumps 33, a wiper member 39 for wiping ink adhered to the record heads 25, and the like.

When the carriage 20 of the ink jet recorder 1 is situated in the non-printing area and at the recovery position, if the need arises, the recovery device 30 is moved upward to not only protect the record heads 25 but also suck the retained ink.

Next, description will be given below of the structure of the recovery device 30. In this embodiment, there is shown a recovery device which includes two caps corresponding to two record heads (see FIGS. 1 and 10).

Two caps 31 (31A, 31B), which are so provided as to correspond to two record heads 25 (25A, 25B), are respectively formed of elastic material and are also formed in a hollow shape having a suction port 311. Each cap 31 includes an absorbing member 350 held in the interior of the cap 31, a rib 310 provided in the periphery of the suction port 311 and contactable with the record head 25, and an air-communication passage 315 which is formed in one side wall of the cap 31 and allows the interior of the cap 31 to communicate with the air.

The cap 31 further includes an opening 317 formed in the bottom portion thereof and thus the cap 31 is connected with a pump 33 serving as suction means through an ink suction passage 35 formed of elastic material. Also, the cap 31 is held by a cap holder 316, is stored in a holder 300 through a spring 313, and can be moved in the direction of the record head as the holder 300 is moved.

The holder 300 includes a number of storage chambers 305 corresponding to the number of caps provided (in the present embodiment, the number is 2), and two guide grooves 301 respectively extending outwardly from the storage chambers 305. On the outer wall of the holder, there is projectingly provided a position restrict plate 302.

Each of the two guide grooves 301 of the holder 300 is used to guide the guide projections 401 which are provided in a closing member 400 serving as an opening/closing valve for the air-communication passage 315.

The closing members 400 are structured such that the guide projections 401 provided on the two side surfaces thereof are guided into the guide grooves 301 of the holder 300 and are interposed between the holder 300 and a spring stopper 306 of the holder 300 through springs 405. When the springs 405 apply loads to the closing members 400 in a direction of an arrow Y in FIG. 10, the closing members 400 are moved to their respective positions where they can close the air-communication passages 315 of the caps 31. Each of the closing members 400 includes a guide boss 404 which is provided on and hangs down from the lower surface thereof.

Now, the holder 300 is placed on a stage 500 through a spring 307.

The stage 500 includes a hole portion 510 forming a cam surface 515, and two movement restrict plates 501 respectively erected on the two sides thereof. The cam surface 515 includes two cam raises 515*a* and 515*b*. The movement restrict plates 501 are so structured as to have a height that causes no interference with the position restrict plate 302 of the holder 300.

The holder 300 is disposed in such a manner that, with the guide bosses 404 of the closing members 400 inserted into the hole portion 510 of the stage 500, the holder 300 is energized by the spring 307 and is thereby caused to wait on one movement restrict plate 501 side. When a drive force is applied thereto, the holder 300 can be moved within the stage 500 along the cam surface 515 in a direction of an arrow X.

The thus structured recovery device sucks ink from the record head and moves the thus sucked ink from the cap to the ink suction passage in linking with the operation of the record head.

Next, description will be given below of the operation of the recovery device (see FIGS. 7, 8 and 9).

The carriage 20 is reciprocated along the shafts 12 and 14 while it is carrying the two record heads 25A and 25B thereon.

Figure 7:
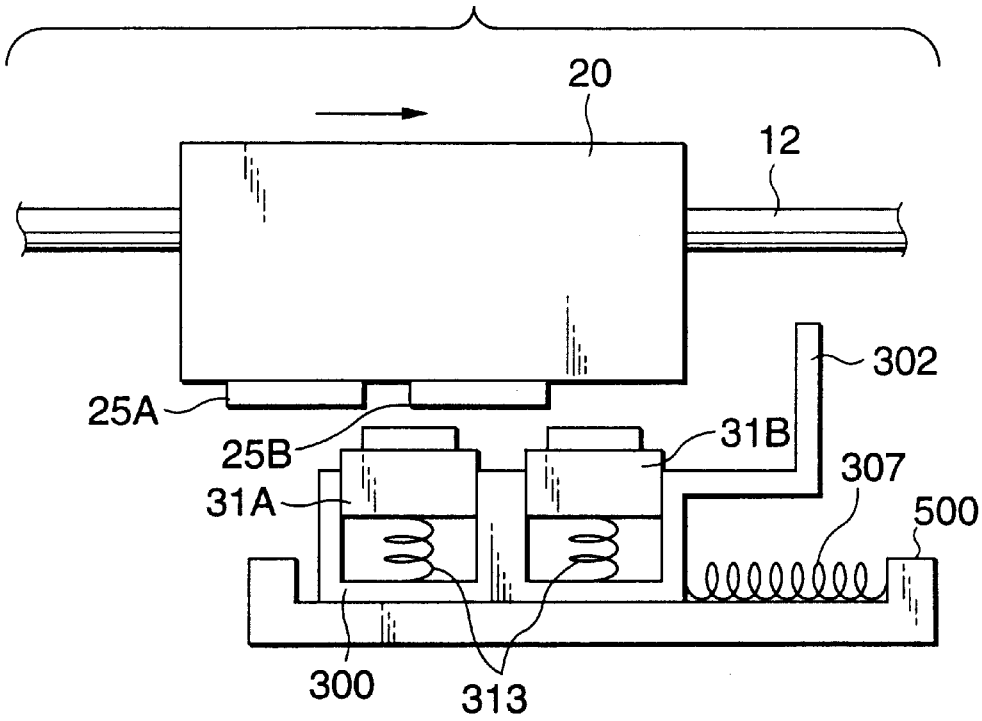
FIG. 7 is an explanatory view of the operation steps of the present ink jet recorder.
Figure 8:
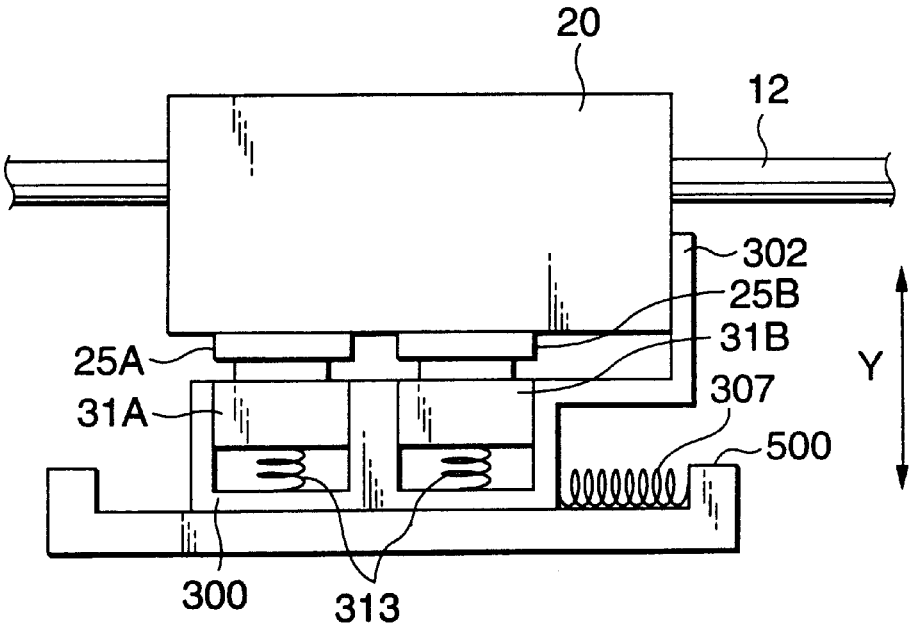
FIG. 8 is an explanatory view of the operation steps of the present ink jet recorder.

After a printing operation is finished, the carriage 20 moves in a direction of an arrow shown in FIG. 7 from the printing area D to the non-printing (recovering) area C (see FIG. 7). Further, if the carriage 20 is moved to a position above the recovery device 30, then the carriage 20 is contacted with the position restrict plate 302 disposed in the holder 300. After then, the carriage 20 moves further on together with the holder 300 and, when the record heads 25 arrive at positions corresponding to the caps 31, the stage 500 is moved upward to bring the caps 31A and 31B into contact with the record heads 25A and 25B, thereby causing the ribs 310 of the caps 31 to cover the peripheral portions of the nozzles of the record heads 25, so that the record heads 25 and caps 31 are airtightly connected with each other (see FIG. 8).

Figure 9:
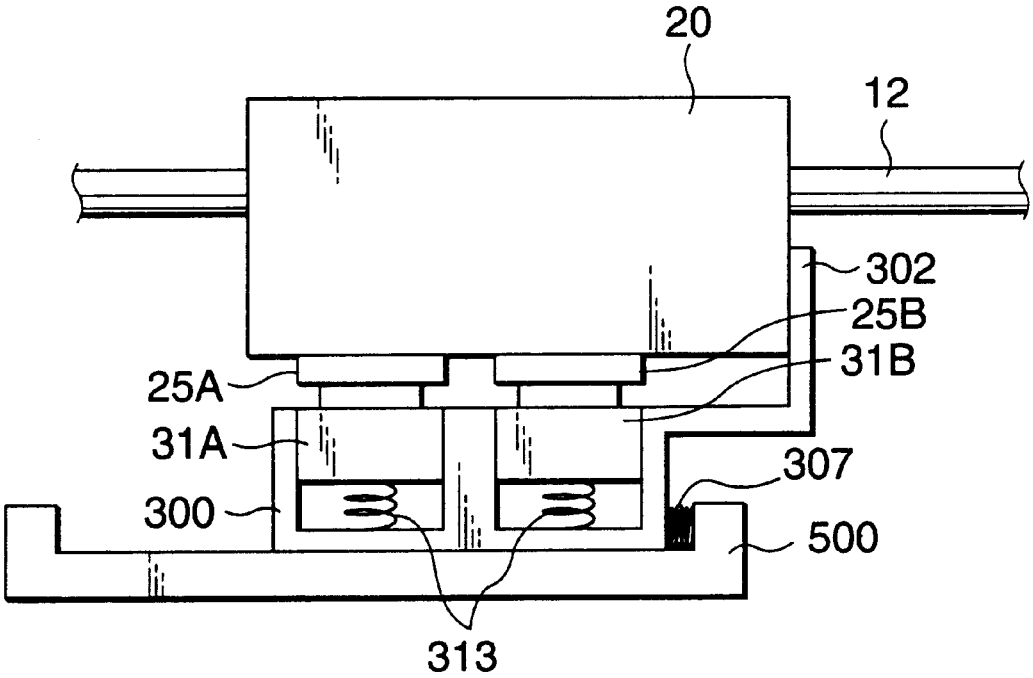
FIG. 9 is an explanatory view of the operation steps of the present ink jet recorder.

Further, if the carriage 20 advances further on in the arrow direction against the energizing force of the spring 307, then the carriage 20 reaches the position for recovering the record heads (see FIG. 9).

In this state, due to the elasticity of the spring 307, the holder 300 is allowed to follow the movement of the carriage 20.

Figure 10:
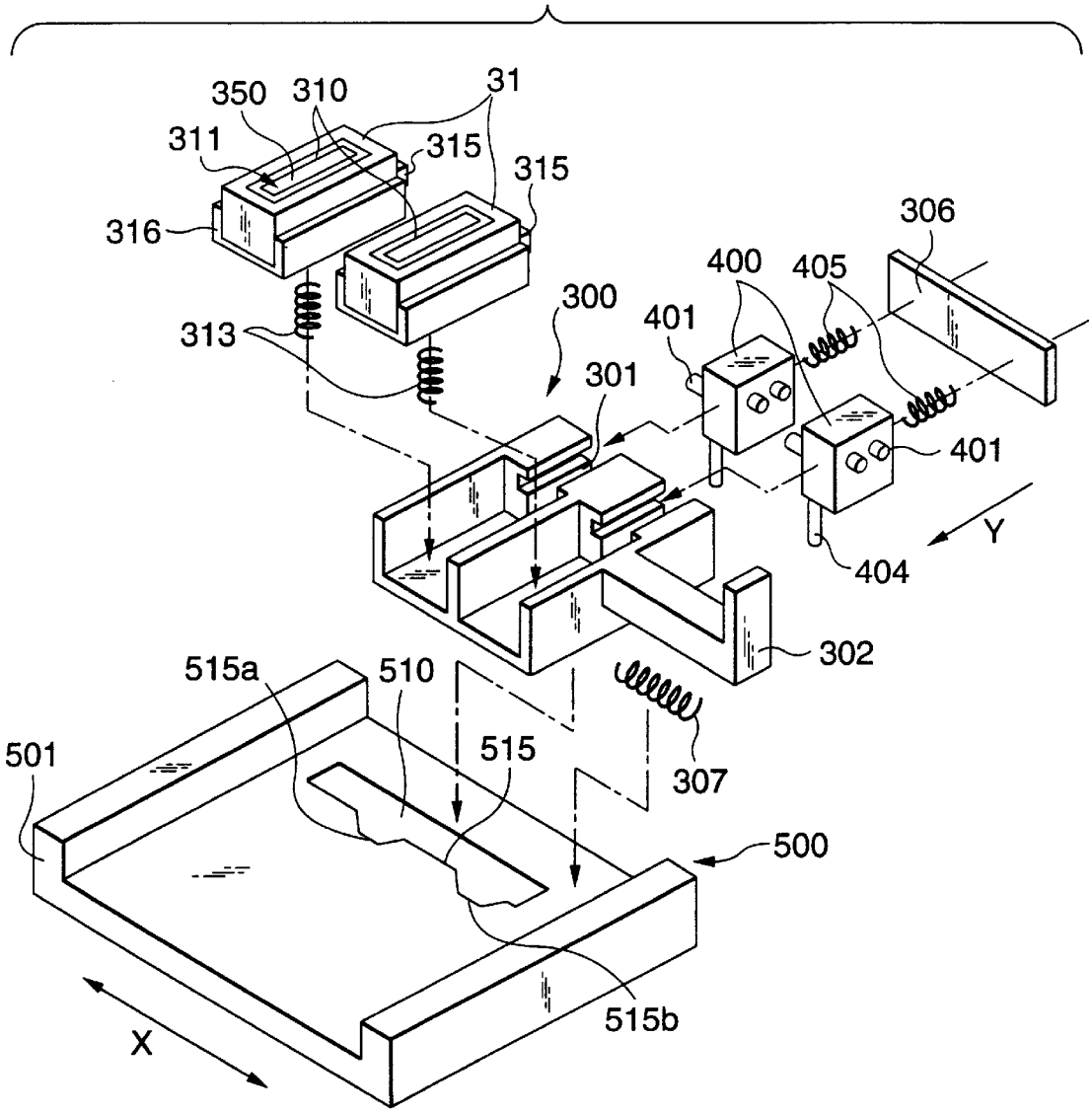
FIG. 10 is an explanatory exploded view of the recovery device.

On the other hand, referring to the movement of the closing members 400 mounted on the holder 300, as the holder 300 moves, the closing members 400 are moved in a direction of an arrow X shown in FIG. 10 with the guide bosses 404 thereof inserted into the hole portion 510 of the stage 500. During this operation, the guide bosses 404 are moved along the cam surfaces 515 and, when the guide bosses 404 are respectively situated on the cam raises 515*a* and 515*b*, the closing members 400 are guided by the guide grooves 301 of the holder 300 and are thereby moved in the cap 31 direction (in the arrow Y direction). Due to such movements of the closing members 400, the closing members 400 are contacted with the air-communication passages 315 of the caps 31 to thereby close the present passages 315. Also, when the guide bosses 404 are situated on the linear portion of the cam surface 515, the closing members 400 are moved in the opposite direction and thus they are separated from the air-communication passages 315, thereby opening the air-communication passages 315.

Next, description will be given below of an ink suction step to be executed when the pumps 33 of the recovery device 10 are operated.

(1) Ink suction step of sucking ink from record head (a first ink suction step)

The caps 31 are connected with the record heads 25, and the closing members 400 are closing the air-communication passages 315. If the pumps 33 are operated, then the pressure within the caps 31 is turned into a negative pressure, so that ink retained within the nozzles of the record heads 25 is sucked into the caps 31.

(2) Ink suction step of sucking ink sucked into cap (a second ink suction step)

The caps 31 are connected with the record heads 25 and the closing members 400 are opening the air-communication passages 315. If the pumps 33 are operated, then the air is sucked in from the air-communication passages 315. During this operation, ink existing in the neighborhood of the air-communication passages 315 of the caps 31 is discharged in the ink suction passage 35 direction.

(3) Ink suction step of sucking ink sucked into cap (a third ink suction step)

The connection between the caps 31 and record heads 25 is removed, and the closing members 400 are opening the air-communication passages 315. If the pumps 33 are operated, then the ink existing within the caps 31 is discharged in the ink suction passage 35 direction.

While description has been given hereinabove of the structure and operation of the recovery device 30 of the ink jet recorder 10, the operations of the respective parts of the recovery device 30 are controlled by a control unit which is provided in the recovery device 30.

Next, description will be given below of how the control unit controls the respective parts of the recovery device 30.

Figure 1:
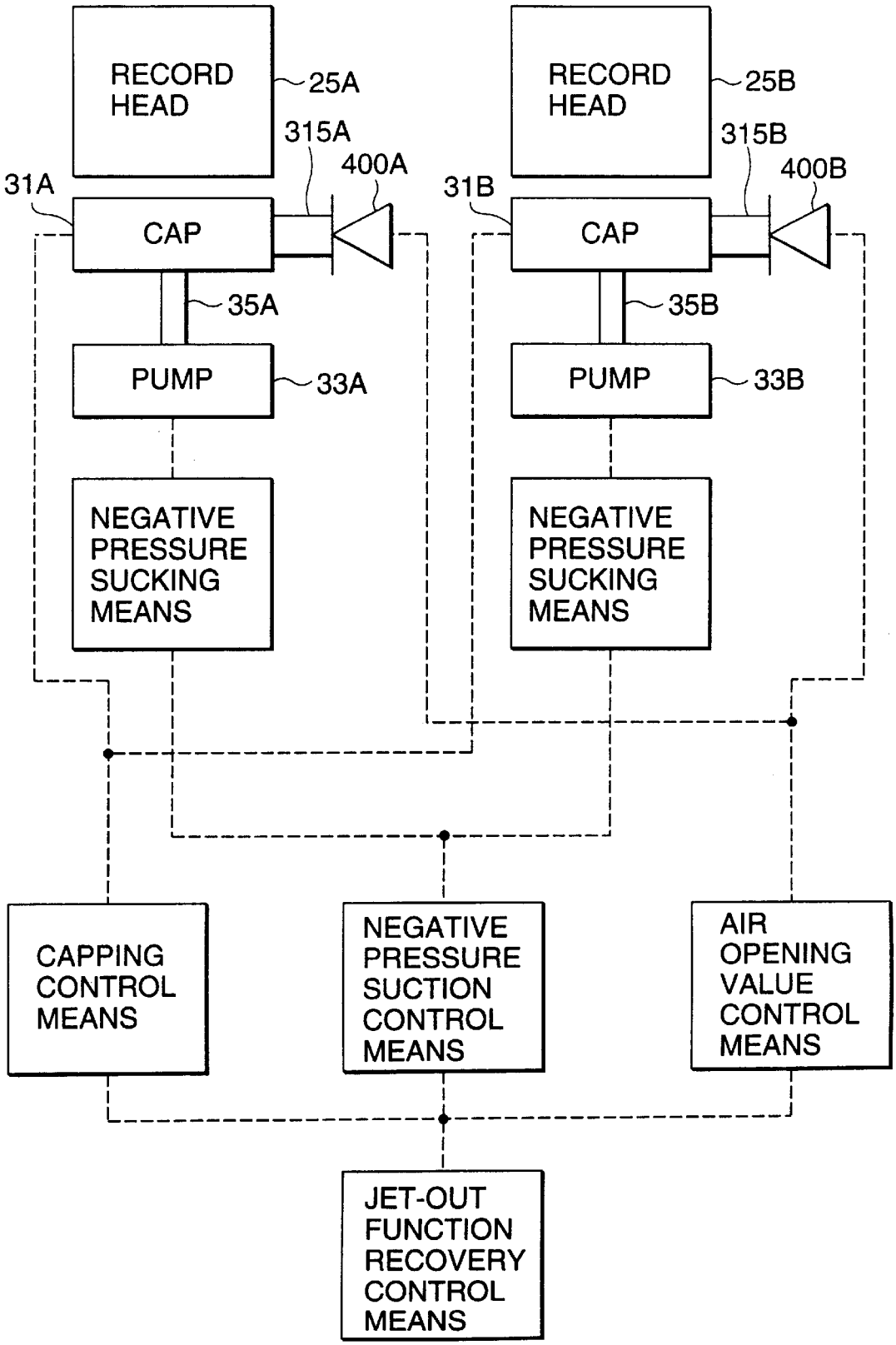
FIG. 1 is an explanatory view of the general structure of an embodiment of an ink jet recorder according to the invention.

Now, FIG. 1 is a block diagram of the general structure of a control system for controlling the recovery of an ink jet function when the record heads of the ink jet recorder are situated in the recovery area.

Exclusive caps 31A and 31B are respectively provided in correspondence to the record heads 25A and 25B, while the caps 31 are respectively connected through the ink suction passages 35 to the pumps 33 serving as negative pressure suction means. The respective caps 31A and 31B are controlled by the control means in such a manner that they can be connected with or disconnected from the record heads 25A and 25B. The operations of the respective pumps 33A and 33B are controlled by negative pressure suction control means. The opening and closing of the air-communication passages 315A and 315B, which are respectively provided in the caps 31A and 31B and are in communication with the air, are controlled by air opening valve control means which controls the motion of the holder 300 used to guide the movement of the closing members 400.

Further, the capping control means, negative pressure suction control means, and air opening valve control means are respectively controlled by the control means (jet-out function recovery control means) of the ink jet recorder.

Figure 2:
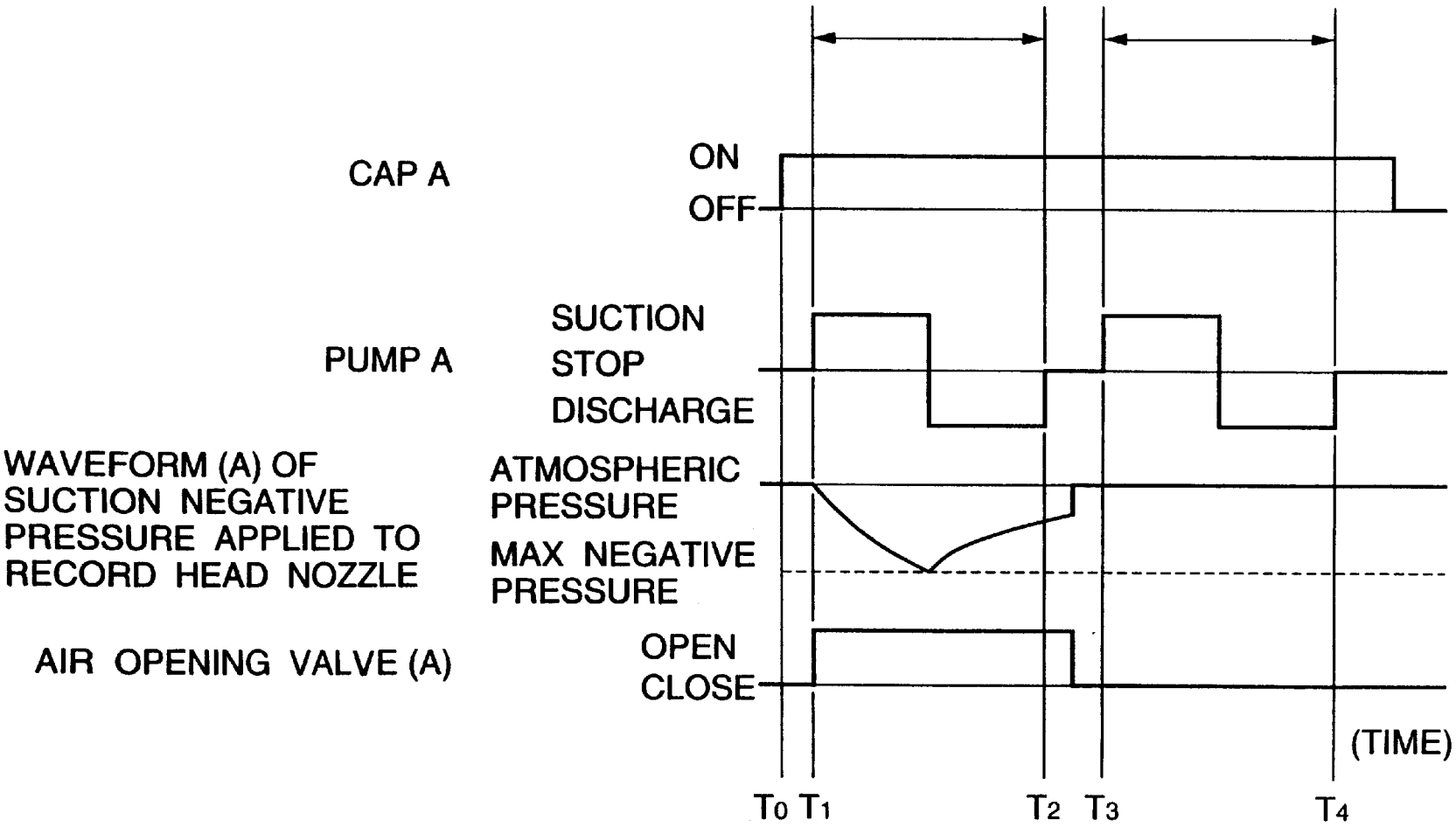
FIG. 2 is a timing chart of a recovery device employed in the present ink jet recorder.
Figure 3:
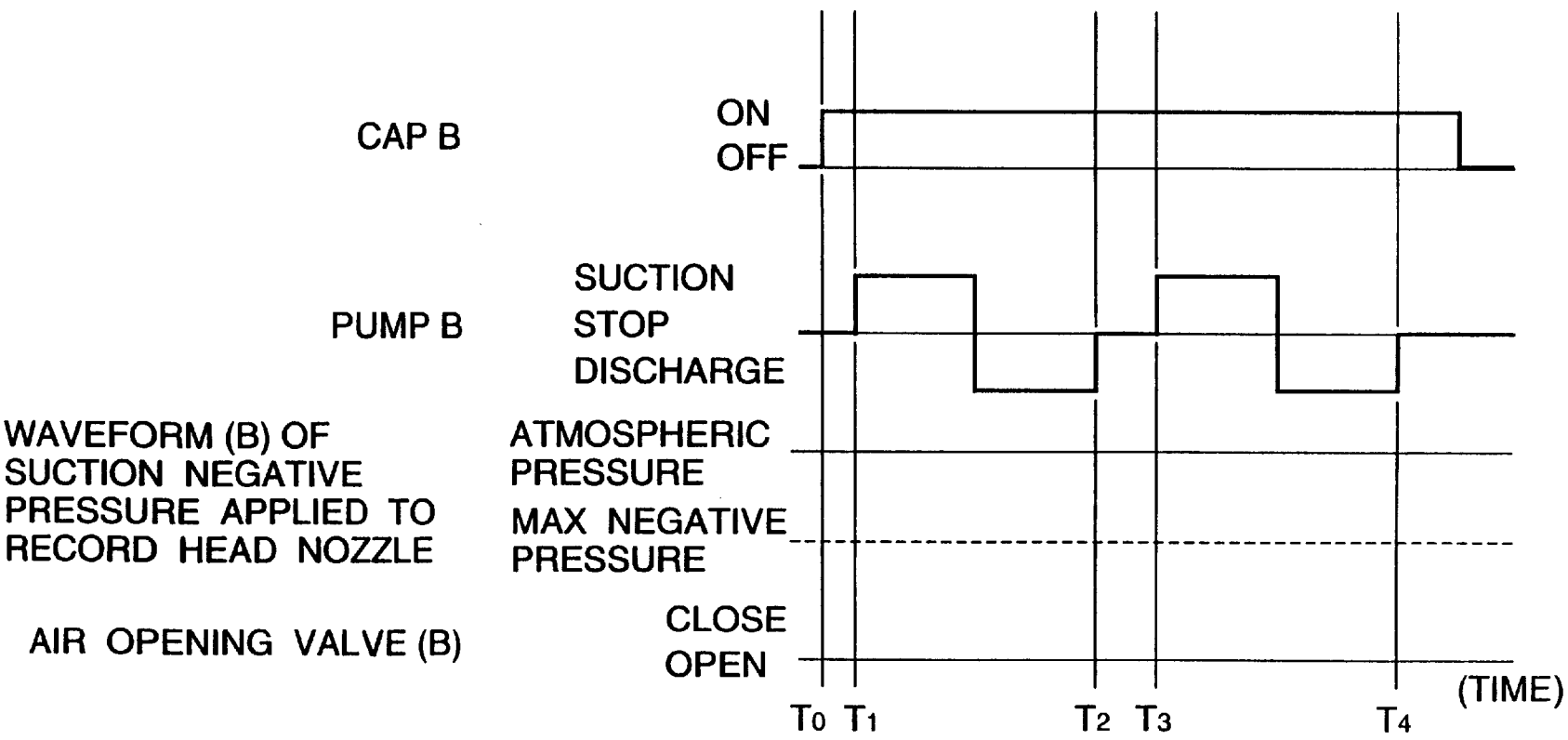
FIG. 3 is a timing chart of a recovery device employed in the present ink jet recorder.

Here, description will be given of the control when the first ink suction step is executed on the record head 25A and the second ink suction step is executed on the record head 25B, with reference to timing charts respectively shown in FIGS. 2 and 3.

The capping control means outputs a cap ON command to the caps 31A and 31B at a timing $T_0$.

In response to this, the caps 31A and 31B are respectively moved upward and are contacted with their corresponding record heads.

At a timing $T_1$, the negative pressure suction control means outputs an operation ON command to the respective pumps 33A and 33B, while the air opening valve control means outputs an ON command to the closing member 400A of the cap 31A and an OFF command to the closing member B of the cap 31B.

Figure 5:
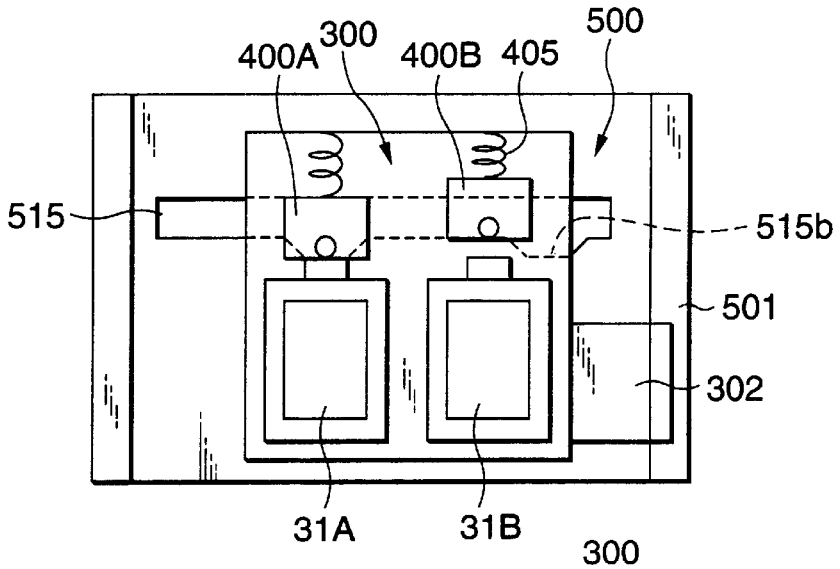
FIG. 5 is an explanatory view of the operation of the recovery device.

The holder 300 is moved in such a manner that the guide boss 404 of the closing member 400A can be situated on the cam raise 515*a* of the cam surface 515 of the stage 500, while the guide boss 404 of the closing member 400B can be situated on the other linear portion of the cam surface 515 than the cam raise portion. Due to this movement, the air-communication passage 315A of the cap 31A is closed by the closing member 400A, while the air-communication passage 315B is opened by the cap 31B (see FIG. 5).

Due to the first operations (suction, discharge) of the pumps 33A and 33B which are operated simultaneously with the movement of the closing members 400, the interior of the cap 31 is turned into a negative pressure condition, so that an operation to suck in ink from the nozzle of the record head 25 (a first ink suction step) is carried out, and the air is sucked into the cap 31B from the opened air-communication passage 315B to thereby carry out an operation to suck ink existing in the cap 31B into the ink suction passage 35B (a second ink suction step). In these ink suction steps, an operation to suck ink from the record head 25B is not executed.

While the capping control means continues outputting the cap ON command to the caps 31A and 31B, at a timing $T_2$, the capping control means outputs an operation stop command to the pumps 33A and 33B, and the air opening valve control means outputs an open command to the closing members 400A and 400B.

Figure 4:
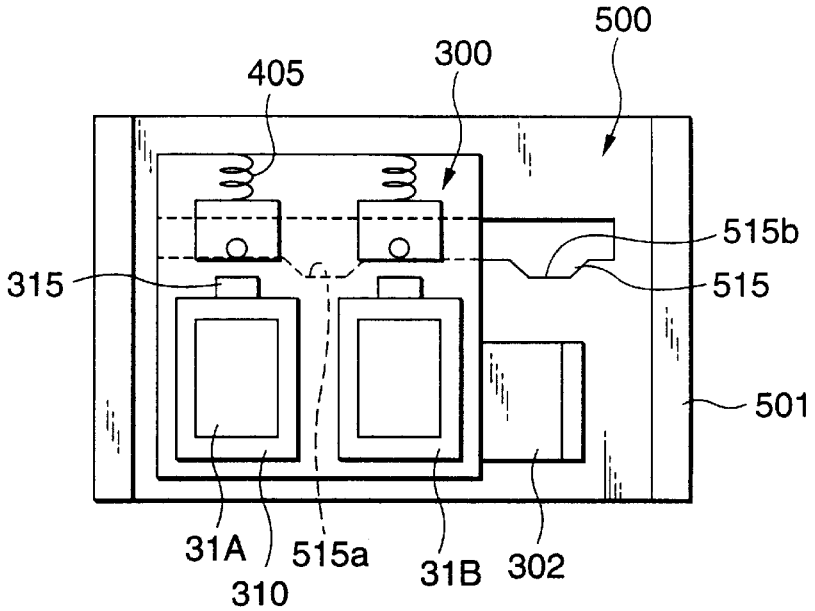
FIG. 4 is an explanatory view of the operation of the recovery device.

The holder 300 is moved in such a manner that the guide bosses 404 of the closing members 400A and 400B can be positioned on the linear portion of the cam surface 515 of the stage 500, thereby opening the air-communication passages 315A and 315B (see FIG. 4). As the air-communication passage 315A is opened, the. negative pressure of the interior of the cap 31A is gradually turned into the atmospheric pressure, while the pressure to be applied to the record head is also turned into the atmospheric pressure.

At a timing $T_3$, the negative pressure suction control means outputs a command for the second operations (suction, discharge) of the pumps 33A and 33B. During a period between the timing $T_3$ and a timing T4, that is, while the pumps are carrying out the suction and discharge operations, the air flows into the caps 31A and 31B respectively from the air-communication passages 315A and 315B so that the pressure in the caps 31A and 31B is turned into the atmospheric pressure. Ink existing within the caps 31A and 31B is sucked into the ink suction passages 35A and 35B (the second ink suction step).

Figure 6:
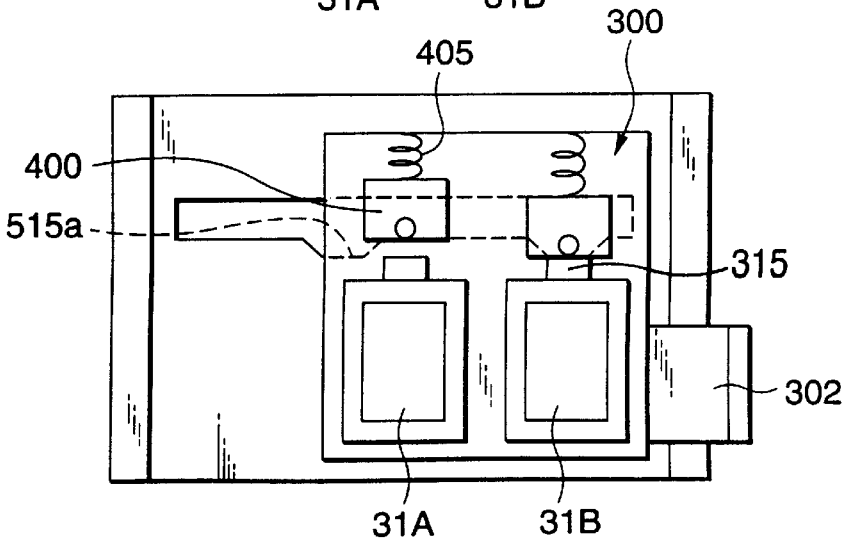
FIG. 6 is an explanatory view of the operation of the recovery device.

Also, as shown in FIG. 6, if the air opening valve control means outputs an open command to the closing member 400A and an ON command to the closing member 400B, then the closing member 400A opens the air-communication passage 315A and the closing member 400B closes the air-communication passage 315B.

Further, although not shown, with the caps 31A and 31B respectively in contact with the record heads 25A and 25B, if the air-communication passages of the caps 31A and 31B are both closed and the pumps 33A and 33B are operated, then the record heads 25A and 25B are both allowed to carry out the first suction step at the same time.

Also, with the caps 31A and 31B respectively separated from the record heads 25A and 25B, and also with the air-communication passages of the caps 31A and 31B both closed, if the pumps 33A and 33B are operated, then the caps 31A and 31B are both allowed to carry out the third suction step at the same time.

As described above, in the present recovery device 30 of the ink jet recorder 10, since the first ink suction step, second ink suction step and third ink suction step can be executed for each of the record heads, one or more of the first ink suction step, second ink suction step and third ink suction step can be selected as the need arises. Also, when it is not necessary to suck ink from the record heads, if the air opening valve control means is operated to thereby stop the suction of ink from the record heads, then the ink can be prevented from being consumed unnecessarily.

In the above-mentioned manner, by combining the above-mentioned suction steps with each other for each of the record heads, it is possible to suck ink only from the record head specified. Also, wasteful consumption of ink due to suction can be restricted and, at the same time, ink retained within the caps can be collected, so that a recovery operation can be executed efficiently and positively.

Further, since ink retained in the caps can be collected positively and sufficiently, there is eliminated the fear that the ink retained in the caps can be pushed out due to a positive pressure generated when the elastic caps are contacted with the record heads.

What is claimed is:

1. An ink jet recorder comprising a record head that jets out ink, a movable head carriage that carries the record head in a main scan direction between a printing area and a non-printing area, and an ink jet recorder recovery device, said recovery device comprising:

a holder;

a plurality of cap members disposed on the holder, each cap member having a suction port and an air-conmmunication passage;

an ink suction device communicating with the respective suction ports;

a plurality of movable closing devices disposed on the holder, wherein each of the movable closing devices independently closes one of the air-communication passages when the movable head carriage contacts and moves the holder in the non-printing area.

2. The ink jet recorder of claim 1, wherein the holder comprises storage compartments that hold the cap members, said storage compartments including at least one guide groove that guides the movable closing devices to open or close said air-communication passages.

3. The ink jet recorder of claim 2, wherein each of the plurality of movable closing devices has a projection that engages the at least one guide groove.

4. The ink jet recorder of claim 1, further comprising a movement restrict plate disposed beneath the holder, the movement restrict plate having a cam surface and side walls.

5. The ink jet recorder of claim 4, wherein each of the plurality of movable closing devices engages the cam surface of the movement restrict plate.

6. The ink jet recorder of claim 4, wherein:

the cam surface of the movement restrict plate includes cam rises, each of the plurality of movable closing devices has a downward projecting boss engaging the cam surface and the cam rises, and each of the plurality of movable closing devices independently closes one of the air-communication passages when the downward projecting boss engages the cam rises and the holder moves toward the non-printing area.

7. The ink jet recorder of claim 4, wherein the holder comprises a position restricting plate, the side walls of the movement restrict plate do not interfere with a movement of the position restricting plate.

8. The ink jet recorder of claim 4, wherein the holder is movable between the side walls of the movement restrict plate.

9. The ink jet recorder of claim 8, further comprising a compression device disposed adjacent to the holder such that the holder is biased between the side walls of the movement restrict plate by the compression device.

10. The inkjet recorder of claim 1, further comprising a compression device stopper disposed proximate to the plurality of movable closing devices, the movable closing devices being biased between the cap members and the compression device stopper by a closing compression device, the movable closing devices being biased in substantially a perpendicular direction from a movement of the holder.

11. The ink jet recorder of claim 1, wherein the ink suction device communicates with openings in the plurality of cap member.

12. The ink jet recorder of claim 1, further comprising a control means that controls at least one of movement of the cap members and the movable closing devices.

13. The ink jet recorder of claim 12, wherein said control means controls the movable closing devices to set the movable closing devices separate from said air-communitication passages when said cap members contact said record heads or separate from said record heads.

14. The ink jet recorder of claim 12, wherein said control means controls any of said movable closing device to operate said ink suction device when that cap member is separated from said record head for sucking ink retained in that cap member.

15. A method for recovering ink in a record head in an ink jet recorder, the ink jet recorder having a plurality of movable record heads that move in a main scan direction, the movable record heads jetting out ink from ink jet ports for printing on a recording sheet, and a recovery device that carries out an ink recovery operation for said movable record heads, said method comprising the steps of:

capping each of said movable record heads with a cap member corresponding to each of said movable record heads when said movable record heads are situated at a recovery position;

sucking ink from the movable record heads through said cap members corresponding to said movable record heads after said capping;

opening an air-communication passage provided in any of said corresponding cap members with a closing device, said air-communication passage being closed when the corresponding movable record head contacts and moves said cap member in a non-printing area;

controlling whether said steps of capping, sucking and opening are executed for each of said record heads; and moving said closing device in a perpendicular direction in relation to a movement of any of said movable recording heads to independently close said air-communication passage.

16. A method for recovering ink in a record head in an ink jet recorder, the ink jet recorder having a plurality of movable record heads that moves in a main scan direction, the movable record heads jetting out ink from ink jet ports for printing on a recording sheet, and a recovery device that carries out an ink recovery operation for said movable record heads, said method comprising the steps of:

capping any of said movable record heads with a cap member corresponding to that movable record head when said movable record heads are situated at a recovery position;

sucking ink from any of said movable record heads through said cap member corresponding to that movable record head after said capping;

opening an air-communication passage provided in said corresponding cap member with a closing device, said air-communication passage being independently closed when said at least one of said movable record heads contacts and moves said cap member in a non-printing area; and controlling whether said steps of capping, sucking and opening are executed for each of said record heads;

wherein the sucking ink step occurs when (i) the cap member contacts the record head, (ii) the air-communication passage is closed, and (iii) a suction pump is operating.

17. A method for recovering ink in a record head in an ink jet recorder, the ink jet recorder having a plurality of movable record heads that moves in a main scan direction, the movable record heads jetting out ink from ink jet ports for printing on a recording sheet, and a recovery device that carries out an ink recovery operation for said movable record heads, said method comprising the steps of:

capping any of said movable record heads with a cap member corresponding to that movable record head when that movable record head is situated at a recovery position;

sucking ink from any of said movable record heads through said cap member corresponding to that movable record head after said capping;

opening an air-conmmunication passage provided in said corresponding cap member with a closing device, said air-communication passage being independently closed when that movable record head contacts and moves said corresponding cap member in a non-printing area; and controlling whether said steps of capping, sucking and opening are executed for each of said record heads;

wherein the sucking ink step occurs when (i) the cap member contacts the record head, (ii) the closing device is separated from the air-communication passage, and (iii) a suction pump is operating.

* * * * *